US007347678B1

(12) United States Patent
Deems et al.

(10) Patent No.: US 7,347,678 B1
(45) Date of Patent: Mar. 25, 2008

(54) FRICTION REDUCING SEAL RING FOR GEAR PUMP

(76) Inventors: Donald D. Deems, 22 W. Edwards, Edmond, OK (US) 73003; Anthony S. Jungels, 3900 NE. 139th St., Edmond, OK (US) 73013

( * ) Notice: Subject to any disclaimer, the term of this patent is extended or adjusted under 35 U.S.C. 154(b) by 553 days.

(21) Appl. No.: 10/923,204

(22) Filed: Aug. 20, 2004

Related U.S. Application Data

(60) Provisional application No. 60/497,537, filed on Aug. 25, 2003.

(51) Int. Cl.
*F03C 4/00* (2006.01)
*F04C 18/00* (2006.01)
*F04C 2/00* (2006.01)

(52) U.S. Cl. ..... 418/171; 418/77; 418/142; 418/152

(58) Field of Classification Search ..... 418/77, 418/142, 152, 166, 171
See application file for complete search history.

(56) References Cited

U.S. PATENT DOCUMENTS 4,145,167 A * 3/1979 Baatrup ..... 418/61.3
5,161,961 A 11/1992 Zheng
6,071,102 A * 6/2000 Hjelsand ..... 418/61.3
6,152,717 A * 11/2000 Morita et al. ..... 418/171
6,158,997 A 12/2000 Post
6,824,486 B2 * 11/2004 Maeno et al. ..... 418/166

FOREIGN PATENT DOCUMENTS

JP 03202686 A * 9/1991 ..... 418/171

OTHER PUBLICATIONS

Howstuffworks "How Automatic Transmissions Work"; Karim Nice; http://auto.howstuffworks.com/automatic-transmission.htm.

* cited by examiner

*Primary Examiner*—Theresa Trieu
(74) *Attorney, Agent, or Firm*—Randal D. Homburg

(57) ABSTRACT

A seal ring for improving the performance of a gear pump, primarily for vehicle transmissions, comprises the milling of a circular ring on at least one lateral face of an inner gear and an outer gear in a gear pump and inserting a friction reducing ring within the milled circular ring. The addition of this ring, especially on remanufactured gear pumps, will reduce the amount of transmission fluid leaking between the gears and the gear pump housing and also reduce the friction between the gears and the gear housing, thus providing more fluid to the transmission and also increasing the pressure while decreasing the amount of heat of the transmission fluid being circulated through the gear pump.

3 Claims, 4 Drawing Sheets

FRICTION REDUCING SEAL RING FOR GEAR PUMP

CROSS REFERENCE TO RELATED APPLICATIONS

Provisional Patent Application No. 60/497,537 filed Aug. 25, 2003.

I. BACKGROUND OF THE INVENTION

1. Field of the Invention

A seal ring for improving the performance of a gear pump, primarily for vehicle transmissions, comprises the milling of a circular ring on at least one lateral face of an inner gear and an outer gear in a gear pump and inserting a friction reducing ring within the milled circular ring. The addition of this ring, especially on remanufactured gear pumps, will reduce the amount of transmission fluid leaking between the gears and the gear pump housing and also reduce the friction between the gears and the gear housing, thus providing more fluid to the transmission and also increasing the pressure while decreasing the amount of heat of the transmission fluid being circulated through the gear pump.

2. Description of Prior Art

An automatic transmission in an automobile allows the engine to operate within a narrow range of speeds while providing a wide range of travel speeds. The transmission serves to provide several gears, allowing the automobile to accelerate while maintaining the engine within its confined limits of operation. When observing the automatic transmission, the basic assortment of components include a planetary gearset, having a sun gear, planet gears, their carrier and a ring gear, a set of bands to lock the gearset, a set of wet-plate clutches to lock other parts of the gear set, a hydraulic system to control the clutches and bands, and a gear pump to circulate the transmission fluid within the transmission.

Essentially, this gear pump is located in the cover or housing of the transmission and has a housing within which an inner gear and an outer gear are seated. The gear pump draws fluid from a sump in the bottom of the transmission and feeds it to the hydraulic system, the transmission cooler and the torque converter. The inner gear of the pump is placed concentrically within the outer gear, with the inner gear hooking up to the housing of the torque converter, and spinning at the speed of the engine, while the outer gear, driven and turned by the inner gear, rotates, drawing the fluid up from the sump on one side and forcing the fluid to the other side to the hydraulic system. The operation of the gear pump is know in the prior art, as indicated in the disclosed literature entitled "How Automatic Transmissions Work", which is an online basic tutorial guide.

Over time, the gear pump housing and the inner and outer gears often wear due to heat and friction of the rotating inner and outer gears, creating a loss of torque converter pressure, measured by a dynamometer, and transmission cooler flow, causing the transmission to run too hot and eventually burn up, requiring a complete transmission replacement. This occurs more often in poorly maintained vehicles, where the transmission filter is never changed, where the fluid is not replaced when old and burned, or when a transmission is used beyond its intended use, as when towing too heavy a load occurs in an over-drive gear.

The addition of the disclosed seal rings, within the milled circular grooves in the inner and outer gears, restores and improves the operation of the gear pump and thus reduces the cost of repair and increases the efficiency of the transmission pump resulting in a greatly improved operation of the transmission as indicated by greater dynamometer testing and result.

In a review of the prior art, no disclosure was made to an inner and outer gear within a gear pump of an automatic transmission including a circular groove milled into at least one lateral face of each inner gear and outer gear, with a friction resisting ring placed within each respective circular groove, the friction resisting rings serving to reduce friction to the lateral surfaces of the gears and also to seal the contact between the gears and the housing to prevent loss of fluid between the pump housing and the gears, forcing the fluid flow through the gear pump instead of around it.

Other than the prior art indicated in the drawings, U.S. Pat. No. 6,158,997 to Post discloses a gear pump comprising a housing having an inlet and an outlet, a first and second gear having outer perimeter teeth engaging each other laterally, one gear being the drive gear and the other being the pump gear. It is not disclosed as having adaptation to a transmission of an automobile. U.S. Pat. No. 5,161,961 to Zheng, depicts a gear pump in the configuration of the planetary gear arrangement found in a transmission, but not in the adaptive gear pump of the present invention application. The Zheng patent does have radial sealing blocks included within its gear mechanisms, but these sealing blocks are fitted against the tooth tops on the gears, not the lateral faces of an inner gear and an outer gear, and are not friction resisting rings within circular grooves in the lateral faces of the inner and outer gears of the gear pump.

II. SUMMARY OF THE INVENTION

When dealing with remanufactured transmission items, the current state of the art repairs worn gear pumps by machine milling the gears and gear housing to provide a new smooth surface within the gear housing to accommodate new gear pump gears and also some milling to the overall gear pump housing to compensate for the reduction in the thickness of the gear housing. Using this method, seldom is any factory efficiency of the gear pump ever restored, and this repair merely sets the gear pump within tolerable limits of operation. The tolerance and smoothness of the remanufactured gear pump is less stringent than the factory tolerance. As a result, the gear pump can have a small but detrimental leak of transmission fluid being fed to through the gear pump between the gear pump gears and the gear housing of the gear pump housing. This leak can cause significant problems even if slight.

First, this small leak around the inner or outer gear can cause a significant reduction in fluid pressure and volume in the transmission which requires a steady bath of transmission fluid to operate efficiently, especially where significant amounts of fluid do not circulate through the intended fluid inlet and outlets of the gear pump. Second, even slight deviation from factor tolerance can cause an increase in the temperature of the transmission fluid, which is detrimental to all parts of the transmission, reducing the life of the transmission components.

It is therefore the objective of the invention to provide an improvement to a gear pump gear which will seal the area of the transmission gear pump between the gear housing and the gears consisting of a groove milled in at least one lateral surface of each gear pump gear within which is inserted a friction resisting sealed ring. A secondary objective of the improvement is to provide the sealed ring to increase transmission fluid volume in the transmission by enhancing the efficiency and performance of a remanufactured gear pump to the level of a factory gear pump by increasing the volume of fluid supplied by the pump and lowering the temperature of the circulating fluid in the gear pump.

III. DESCRIPTION OF THE DRAWINGS

The following drawings are submitted with this utility patent application.

FIG. 5 is a bottom sectional view of the inner gear, outer gear and friction resisting rings in the gear pump housing and gear recess.

FIG. 6 is a side cross sectional view of the inner and outer gears within the gear pump housing, along section lines 6/6 of FIG. 5.

IV. DESCRIPTION OF THE PREFERRED EMBODIMENT

Figure 1:
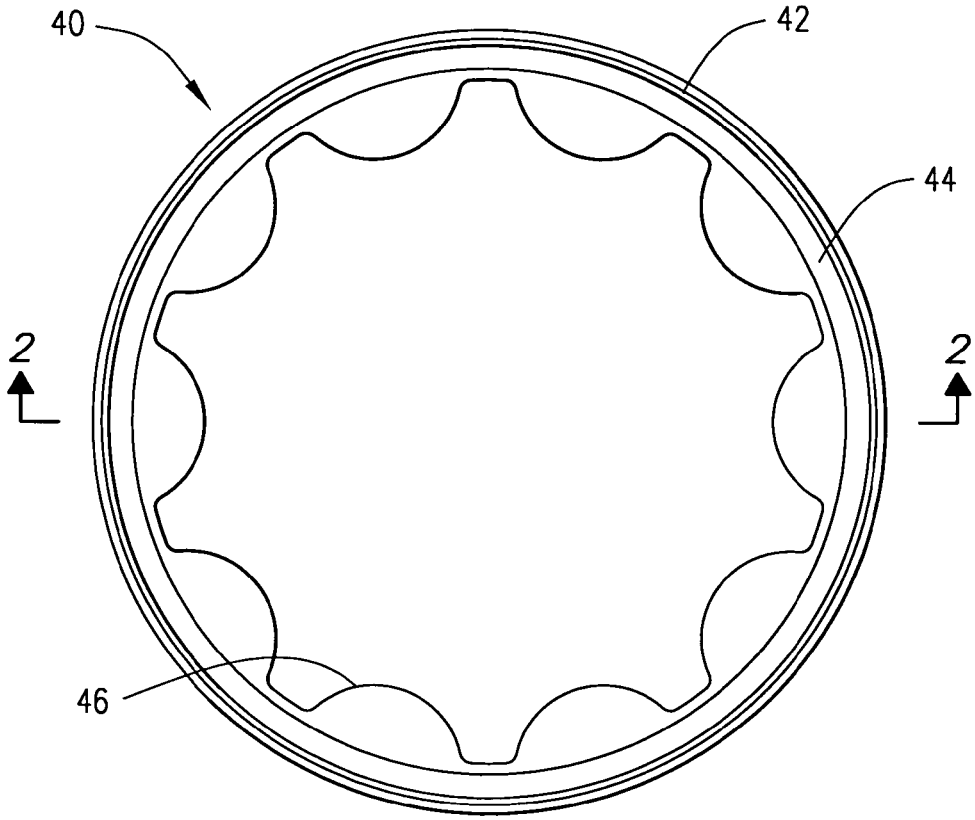
FIG. 1 is a top view of the outer gear with a circular groove.
Figure 2:
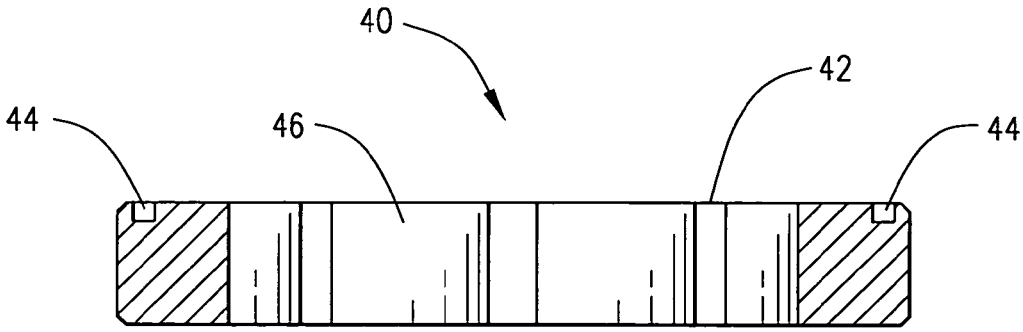
FIG. 2 is a side cross section of the outer gear with the circular groove with the friction resisting ring inserted within the circular groove, along section lines 2/2 of FIG. 1.
Figure 3:
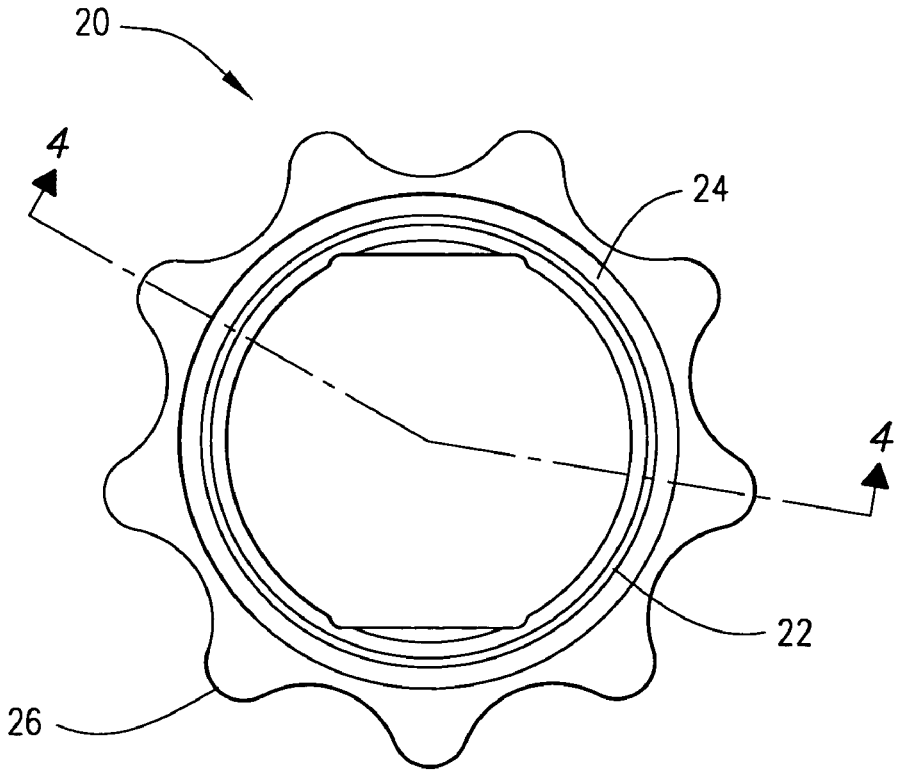
FIG. 3 is a top view of the inner gear with the circular groove.
Figure 4:
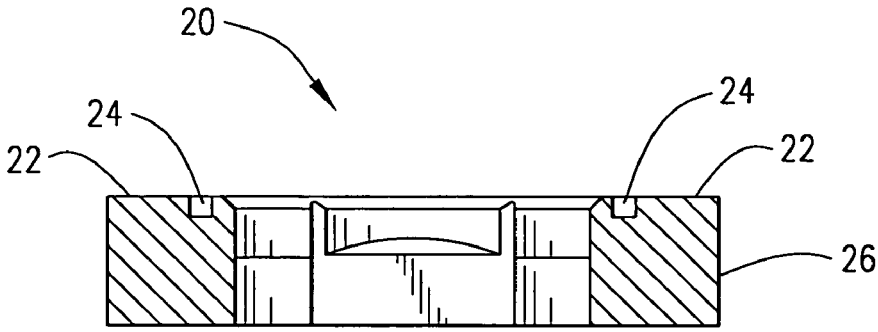
FIG. 4 is a side cross section of the inner gear with the circular groove with the friction resisting ring inserted within the circular groove, along section lines 4/4 of FIG. 3.
Figure 3:
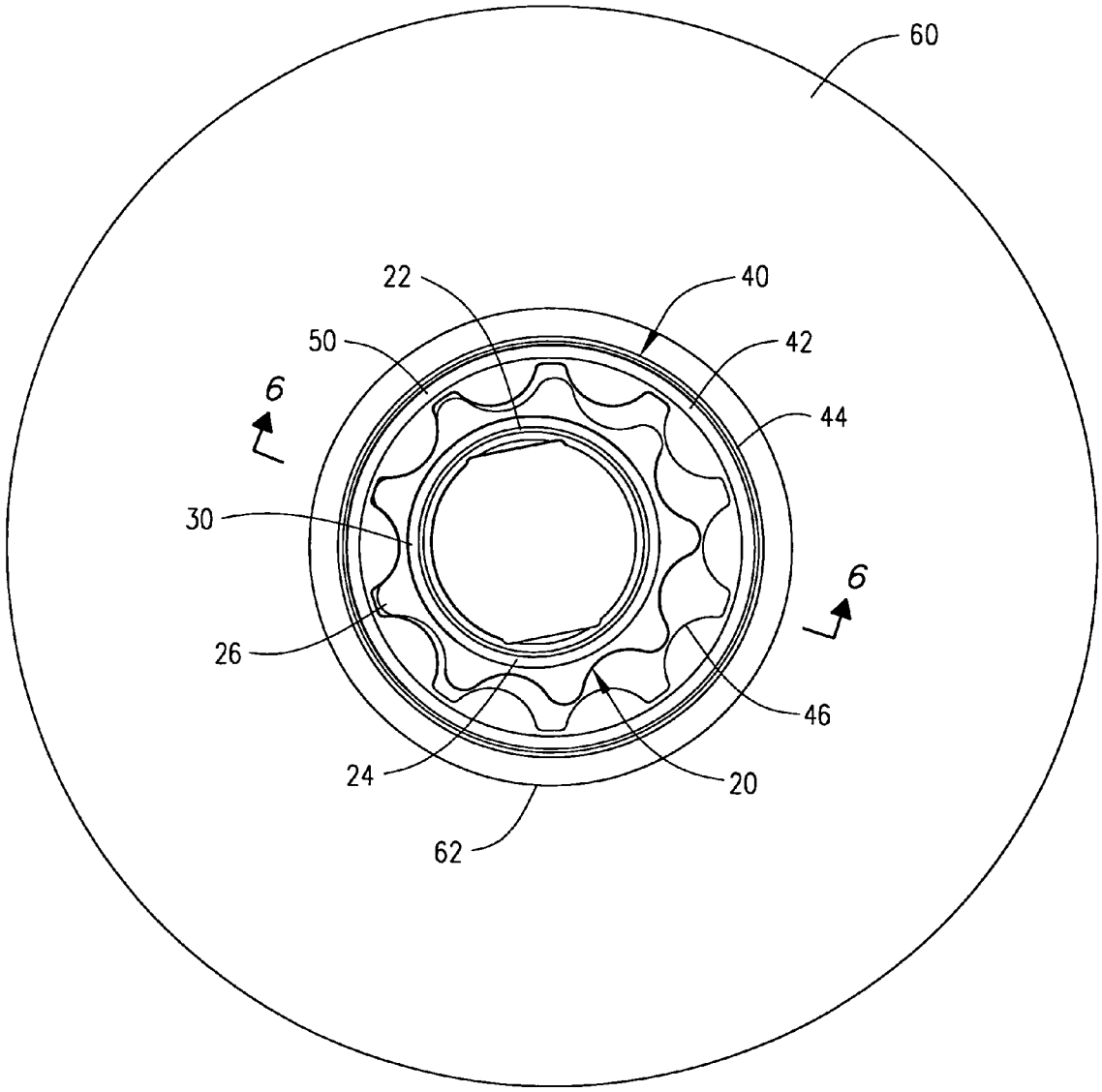
Figure 3:
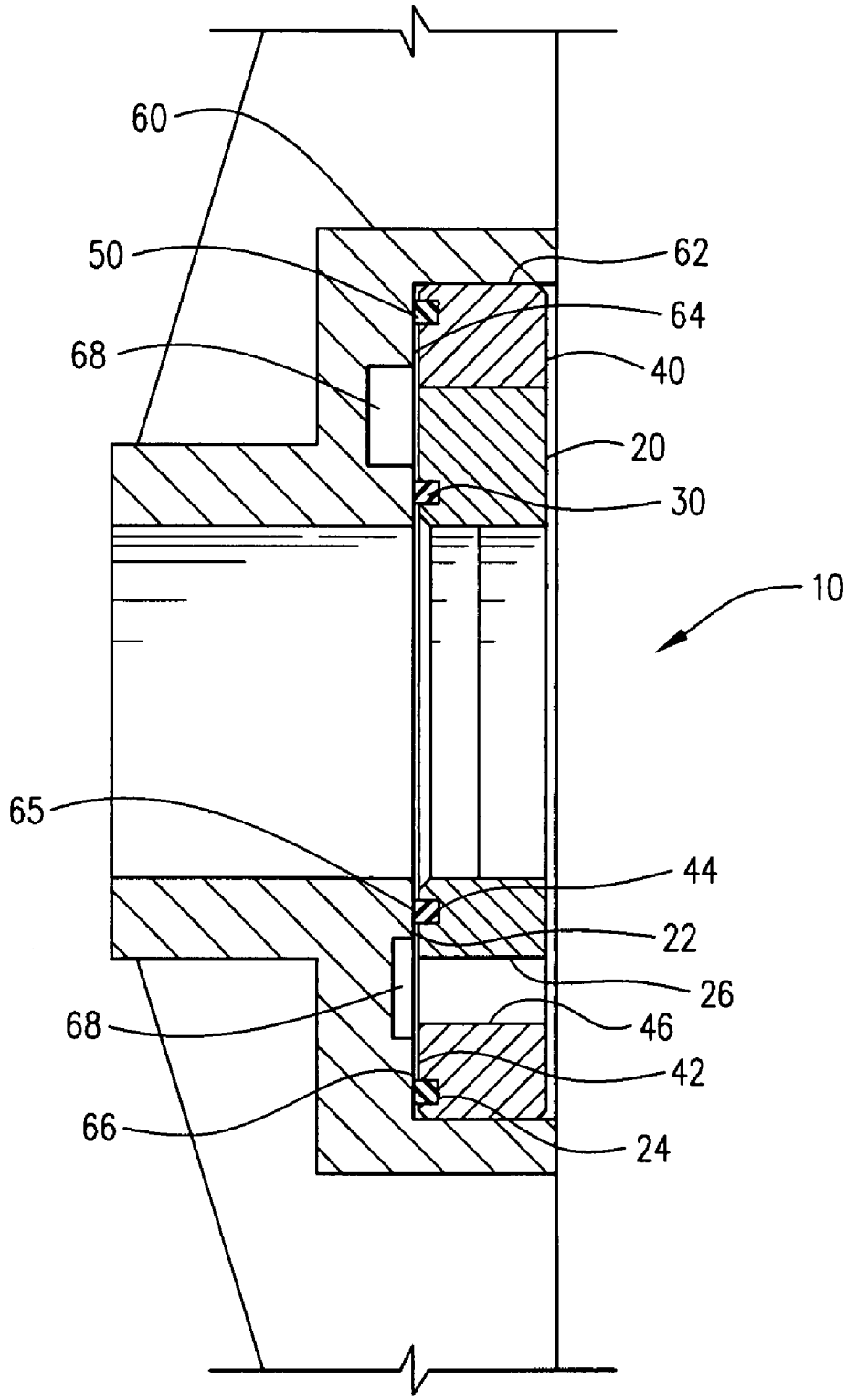

An improved gear pump assembly 10 for automatic transmission gear pumps, shown in FIGS. 1-6 of the drawings, adapted to replace the gear pump assembly in new or used transmissions to improve or restore the efficiency of the gear pump in the transmission, the improved gear pump assembly 10 comprising an inner gear 20 and an outer gear 40 fitted within a gear pump housing 60, each inner gear 20 and outer gear 40 having a circular groove 24, 44 machined on at least one lateral face 22, 42 of each inner gear 20 and outer gear 40, each circular groove 24, 44 being equidistant from a center point of each inner gear 20 and outer gear 40 and of a precision even width and depth, and a friction resisting ring 30, 50 adapted to be inserted within each circular groove 24, 44 of each inner gear 20 and outer gear 40 with a minimum of clearance tolerance, wherein each said friction resisting ring 30, 50 seats within each respective circular groove 24, 44 and spins freely within each circular groove 24, 44.

As shown in FIGS. 1-4 of the drawings, the circular groove 24, 44 on each said inner gear 20 and outer gear 40 is machined within at least one flat lateral face 22, 42, wherein the circular grooves 24, 44 are as smooth as possible, maintaining a uniform minimal distance between the circular grooves 24, 44 and the inserted friction resisting rings 30, 50. FIGS. 5-6 of the drawings depict the friction resisting ring 30, 50 and the circular grooves 24, 44, as assembled.

The inner gear 20 and outer gear 40, including the friction resisting rings 30, 50, are placed within the gear pump housing 60 as shown in FIG. 6, demonstrating the orientation of the inner gear 20 and outer gear 40 relative to the gear pump housing 60 in one embodiment of the improved gear pump assembly 10. The relationship between the inner gear 20 and the outer gear 40 is demonstrated in FIG. 5 of the drawings, illustrating the placement of the inner gear 20, with a set of outer gear teeth 26, engaging a set of inner gear teeth 46 of the outer gear 40. The engaged inner gear 20 and outer gears 40 are placed within the gear pump housing 60 in an automatic transmissions.

As an overview of the known prior art, not fully illustrated in the drawings, but known by those skilled in the art of automatic transmissions, a gear pump assembly is located in the cover or housing of the transmission and defines a gear pump housing within which an inner gear and an outer gear are seated. The gear pump draws fluid from a sump in the bottom of the transmission and feeds it to the hydraulic system, the transmission cooler and the torque converter. The inner gear of the pump is placed concentrically within the outer gear, with the inner gear attaching to the housing of the torque converter, and spinning at the speed of the engine, while the outer gear, driven and turned by the inner gear, rotates, drawing the fluid up from the sump on one side and forcing the fluid to the other side to the hydraulic system.

The gear pump housing 60, shown in FIG. 6, further defines a gear recess 62 wherein the inner gear 20 and outer gear 40 are positioned for operation, the gear recess 62 having an upper contact surface 64. The upper contact surface 64, in the illustrated embodiment of FIG. 6, has an inner contact portion 65 and an outer contact portion 66. The friction resisting ring 30 of the inner gear 20 engages the inner contact portion 65 and friction resisting ring 50 of the outer gear 40 engages the outer contact portion 66, forming a seal surrounding a fluid channel 68 within the upper contact surface 64. This fluid channel 68 is the location where the fluid suction inlet and fluid discharge outlet is located in the gear pump assembly 10. Application of the two friction resisting rings 30, 50 creates an improved seal between the inner gear 20 and inner contact portion 65 and the outer gear 40 and outer contact portion 66, reducing the amount of friction between the inner gear 20 and outer gear 40 against the upper contact surface 64 of the gear recess 62. When properly positioned, fitted and in operation, the friction resisting rings 30, 50 remain relatively stationary in relationship with the inner contact surface 65 and outer contact surface 66, while the inner gear 20 and outer gear 40 rotate in operation of the gear pump assembly 10, the friction resisting rings 30, 50 sealing fluid flow around the inner gear, outer gear and upper contact surface 62, directing the fluid into the fluid channel 68, where it is intended to flow to efficiently operate the transmission.

Most preferably, the material of choice for the friction resisting rings 30, 50 would be TEFLON® or KEVLAR®, and including VITON (ETP)®, KALREZ®, SIMRIZ®, CHEMRAZ®, TEFLON® PFA or polyacrylate, all products required to withstand high temperatures, exposure to transmission fluids and be adapted for dynamic application and fluid seal.

It is noted that in some applications, both lateral surfaces of the inner gear 20 and outer gear 40, not shown, may include the circular grooves 24, 44, and friction resisting rings 30, 50 may be applied within both circular grooves 24, 44 of each inner gear 20 and outer gear 40, depending upon the gear pump being modified and improved.

While the invention has been particularly shown and described with reference to a preferred embodiment thereof, it will be understood by those skilled in the art that changes in form and detail may be made therein without departing from the spirit and scope of the invention.

What is claimed is:

1. An improved gear pump assembly for automatic transmission gear pumps, replacing a gear pump assembly in new or used transmissions to improve or restore the efficiency of the gear pump in the automatic transmission, the improved gear pump assembly comprising:

an inner gear having a circular groove machined on at least one lateral face of said inner gear, said circular groove receiving a friction resisting ring with a minimum of clearance tolerance; and an outer gear having a circular groove machined on at least one lateral face of said outer gear, said circular groove receiving a friction resisting ring with a minimum of clearance tolerance, wherein said assembled inner gear and outer gear are installed within a gear pump housing, each said friction resisting ring spinning freely within each circular groove.

2. The improved gear pump assembly, as disclosed in claim 1, wherein said gear pump housing further comprises:

a gear recess within which said inner gear and outer gear are confined during operation, said gear recess having an upper contact surface defining an inner contact portion and an outer contact portion, said friction resisting ring of said inner gear engaging said inner contact portion and said friction resisting ring of said outer gear engaging said outer contact portion, forming a seal surrounding a fluid channel within the upper contact surface.

3. The improved gear pump assembly, as disclosed in claim 1, wherein said friction resisting ring is a material manufactured to withstand exposure to high temperatures, exposure to transmission fluids and intended for dynamic application and fluid seal, including materials selected from the group consisting of: TEFLON®, KEVLAR®, VITON (ETP)®, KALREZ®, SIMRIZ®, CHEMRAZ®, TEFLON® PFA or polyacrylate.

* * * * *